US006314591B1

(12) United States Patent
Schildt

(10) Patent No.: US 6,314,591 B1
(45) Date of Patent: Nov. 13, 2001

(54) HYGIENIC ODORLESS TOILET FOR THE BLIND AND PHYSICALLY CHALLENGED

(76) Inventor: Patrick W Schildt, Box 1777, Browning, MT (US) 59417

( * ) Notice: Subject to any disclaimer, the term of this patent is extended or adjusted under 35 U.S.C. 154(b) by 0 days.

(21) Appl. No.: 09/655,670

(22) Filed: Sep. 6, 2000

(51) Int. Cl.[7] ..... E03D 11/00
(52) U.S. Cl. ..... 4/420; 4/213; 4/300.1
(58) Field of Search ..... 4/420, 300.1, 300.3, 4/300, 666, 340–342, DIG. 5, DIG. 19, 213

(56) References Cited

U.S. PATENT DOCUMENTS

| | | | | |
|---|---|---|---|---|
| 851,679 | * | 4/1907 | Lloyd | 4/420 |
| 1,607,302 | * | 11/1926 | Pentecost | 4/300.1 |
| 2,049,534 | * | 8/1936 | Byerlein | 4/341 |
| 4,197,598 | * | 4/1980 | Lemmon | 4/341 |
| 4,437,430 | * | 3/1984 | DeBardeleben | 4/300.3 |

FOREIGN PATENT DOCUMENTS

| | | | | |
|---|---|---|---|---|
| 182308-B1 | * | 5/1986 | (EP) | 4/300.1 |
| 8871-B1 | * | 4/1905 | (GB) | 4/341 |

* cited by examiner

*Primary Examiner*—Charles R. Eloshway
(74) *Attorney, Agent, or Firm*—Michael I. Kroll

(57) ABSTRACT

The present invention 10 discloses a toilet for venting 30 malodorous odors by providing one or more air indraft members 32 connected to conduit 36 leading to an exhaust fan or air purification unit, the toilet 22 also preventing cascading water 12 over the rim 20 area caused by clogged passageways within the toilet by having a forwardly located depression 12 acting as a spill way to direct the overflow in one direction thereby reducing the scope of contamination to one area instead of over the toilet bowl exterior surface and surrounding walls. The toilet 22 further has toilet paper holders 24 oppositely opposed to each other molded into the exterior bowl surface providing a consistent location for those people who are visually and physically challenged. Alternative designs are provided for the venting arrangement including air indraft ports 30, air indraft members 32, and multiple apertures 64 connected to an air channel 68 in the rim 20. An alternative design also provides for a hand bar 58 for assistance to a user while using the toilet of the present invention.

17 Claims, 19 Drawing Sheets

HYGIENIC ODORLESS TOILET FOR THE BLIND AND PHYSICALLY CHALLENGED

BACKGROUND OF THE INVENTION

1. Field of the Invention

The present invention relates generally to toilets and more specifically to a toilet having means for venting malodorous odors associated with bowel movements from the toilet bowl area by having an indraft air member mounted to a pocket within the rim or forming an integral part therein wherein the pocket is connected to conduit leading to an exhaust fan or air purification unit.

Further the toilet has means for preventing cascading water over the rim area caused by clogged passageways within the toilet by having a depression acting as a funnel to direct said overflow in one direction thereby reducing the scope of contamination to one area instead of over the toilet bowl exterior surface and surrounding walls and the spillway having a strainer member to retain the solid waste within the toilet bowl while permitting the water to be directed in one direction.

In addition the toilet bowl fixture has toilet paper holders molded into the exterior bowl surface oppositely opposed each other providing a memorably consistent location for those people who are visually and physically challenged and may have access to only one side of the toilet bowl. The toilet paper holders have integrally molded or hinged covers to protect the paper from contamination.

2. Description of the Prior Art

There are other toilet bowl designs which may incorporate one or more of the aforementioned design considerations but none which provides all of the aforementioned components in a unitary unit designed to address the contamination of lavatory surfaces from the inevitable clogged toilet as well as providing a consistent and recognizable environment for the visually and physically challenged and further providing means for the removal of malodorous odors associated with bowel movement from the toilet bowl area.

SUMMARY OF THE PRESENT INVENTION

The present invention discloses a toilet having means for venting malodorous odors by providing one or more air indraft members connected to conduit leading to an exhaust fan or air purification unit and the toilet having means for preventing cascading water over the rim area caused by clogged passageways within the toilet by having a forwardly located depression acting as a spill way to direct said overflow in one direction thereby reducing the scope of contamination to one area instead of over the toilet bowl exterior surface and surrounding walls. The toilet further has toilet paper holders oppositely opposed each other molded into the exterior bowl surface providing a consistent location for those people who are visually and physically challenged. Alternative designs are provided for the venting means including air indraft ports, air indraft members, and multiple apertures connected to an air channel in the rim. An alternative design also provides for a hand bar for assistance to a user while using the toilet of the present invention.

A primary object of the present invention is to provide an improved toilet bowl design having venting means, controller overflow means and consistent locations for toilet paper holders.

Another object of the present invention is to provide an improved toilet bowl having integral receptacles for the insertion of indraft air members wherein said receptacles having an aperture for connecting exhaust conduit.

Yet another object of the present invention is to provide an improved toilet bowl having a depression forwardly located acting as a spillway for the water should the waste passageway become clogged.

A still further object of the present invention is to provide an improved toilet bowl having toilet paper holders integrally molded on each side of the toilet bowl thereby providing a consistent location for the visually and physically challenged.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE PREFERRED EMBODIMENT(S)

In order that the invention may be more fully understood, it will now be described, by way of example, with reference to the accompanying drawings in which FIGS. 1 through 19 illustrate the present invention being a hygienic, odorless toilet for the blind and physically challenged.

Figure 1:
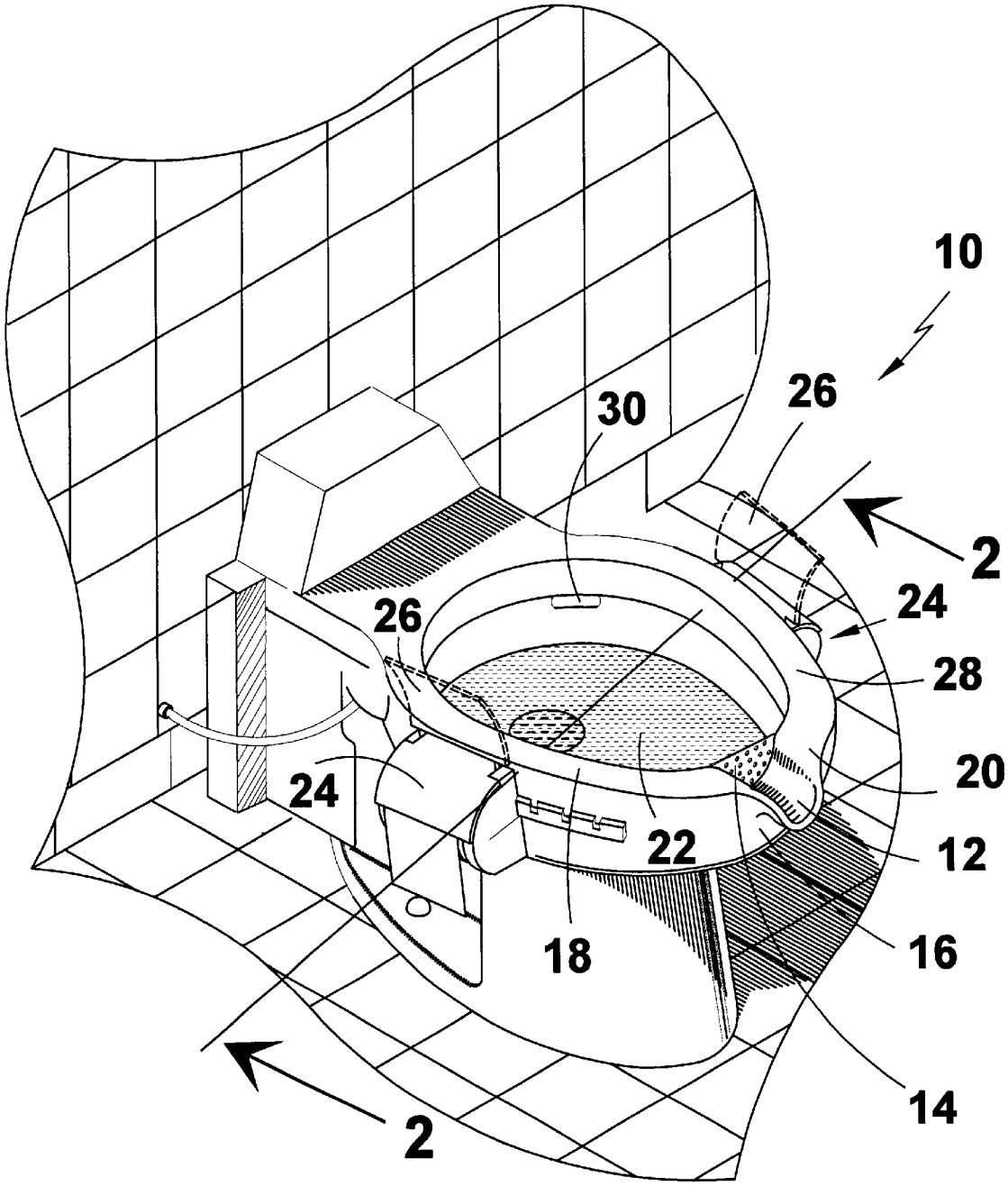
FIG. 1 is a perspective view of the present invention showing the spillway having a solid waste blocking member which will act to channel the overflow, due to waste line blockage, forwardly which will result in less contamination of the exterior toilet bowl surface and reduce splashing of lavatory walls. The channel overflow spout can be located on the front or either side on the top rim of the toilet bowl so as to point the overflow towards the location of a floor drain.

Turning to FIG. 1, shown therein is a perspective view of the present invention 10 showing the spillway 12 having a solid waste blocking member 14 which will act to channel the overflow, due to waste line blockage, forwardly which will result in less contamination of the exterior toilet bowl surface and reduce splashing on lavatory walls. The channel overflow spillway spout 12 can be located on the front 16 or either side 18 on the top rim 20 of the toilet bowl 22 so as to point the overflow towards the location of a floor drain for example. The spillway 12 has the shape of a semi-circle, the semi-circle having a diameter approximately equal to the width of the rim 20 of the toilet bowl. The solid waste blocking member 14 comprises a thin plate having multiple apertures therein and is disposed perpendicular to the spillway 12.

The integrally molded toilet paper holders 24 provide a memorably consistent location for the visually and physically challenged and have either an integrally molded cover 26 or a hinged cover.

The air indraft members (not visible) are located under the rim 20 of the toilet 22 and are connected by means of conduit to an air egress port connected to a forced air exhaust member, not shown, which will draw the air from the toilet bowl area having the malodorous odors and vent the air outside of the lavatory. The toilet seat 28 is formed with the toilet bowl.

Figure 2:
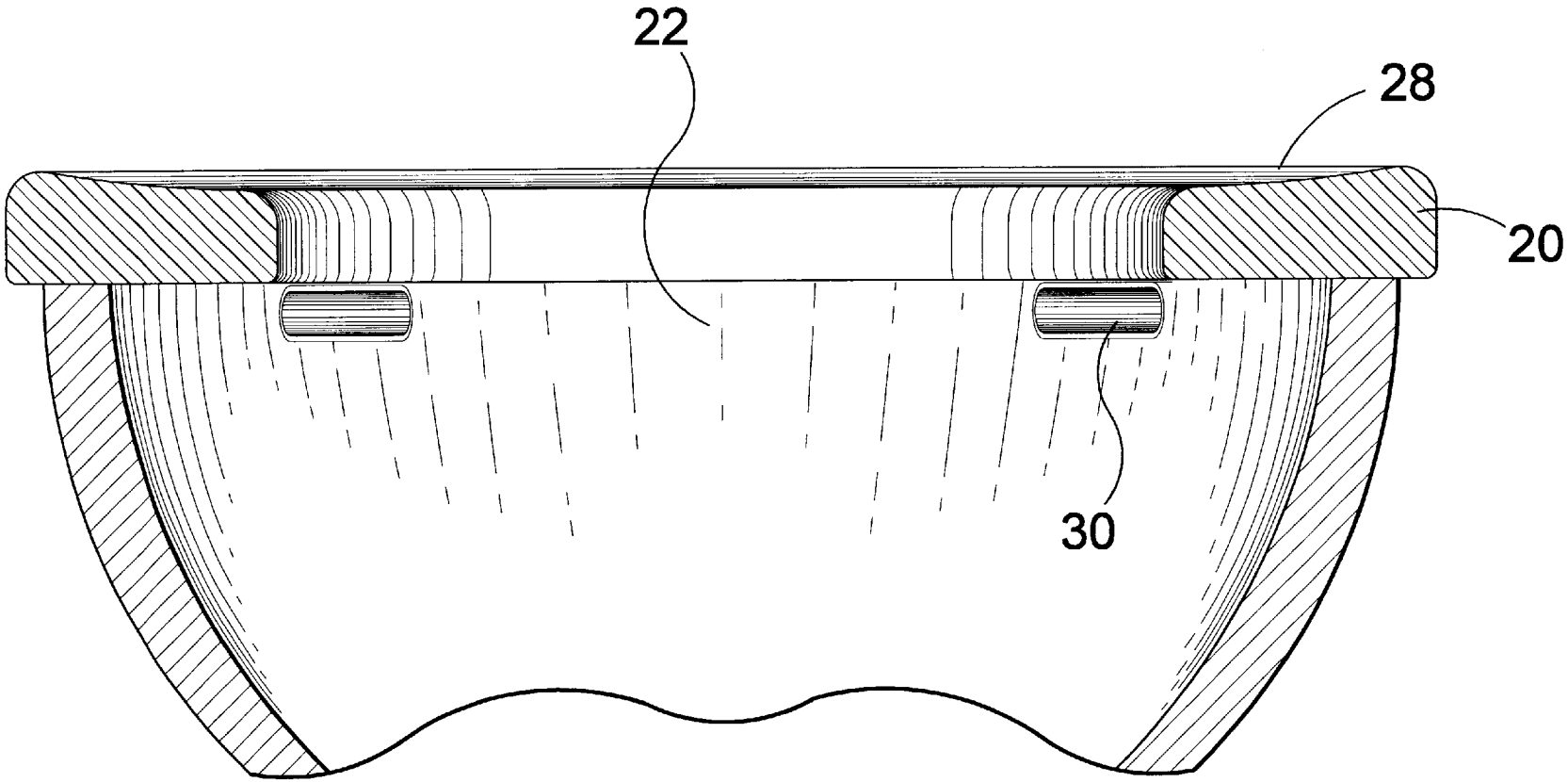
FIG. 2 is a cross sectional view of the toilet, taken from FIG. 1 as indicated, showing the toilet bowl rim/toilet seat having a water passage unit within the rim. Also shown are the air indraft ports which will draw the air from the toilet to an exhaust port outside of the lavatory.

Turning to FIG. 2, shown therein is a cross sectional view of the toilet 22, taken from FIG. 1 as indicated, showing the toilet bowl rim/toilet seat 20, 28 having a water passage unit within the rim. Also shown are the air indraft ports 30 which will draw the air from the toilet 22 to an exhaust port outside of the lavatory.

Figure 3:
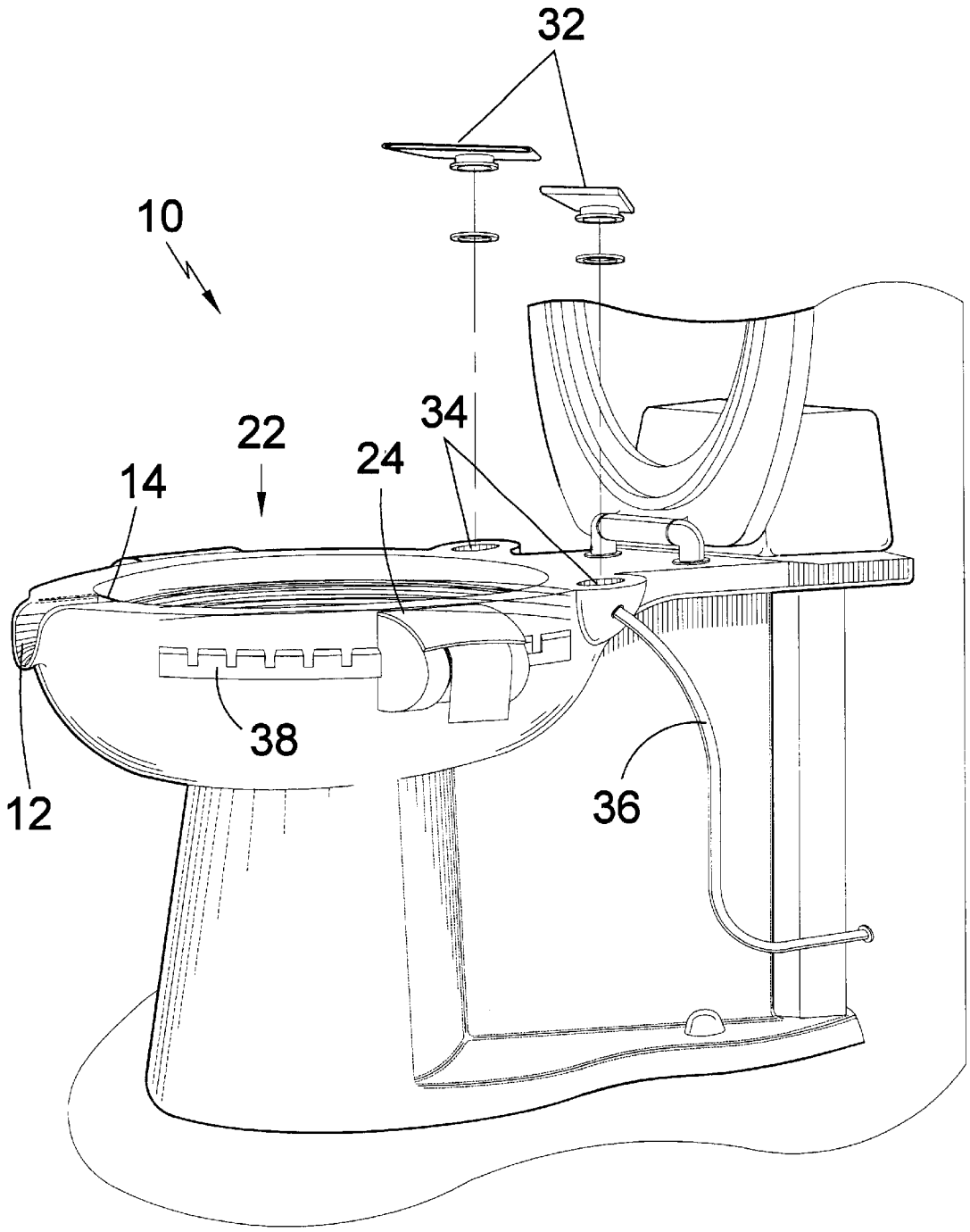
FIG. 3 is a perspective view of the present invention showing the toilet having air indraft members, which are removably attached for cleaning purposes, positioned over the toilet venting receptacles. The toilet venting receptacle egress port is connected by conduit to an egress port for venting said malodorous odors outside of the lavatory. Also shown are integrally molded toilet paper holders providing a consistently memorable location for the blind and physically challenged. The toilet paper holders can be moved either to the front or rear of the toilet bowl to accommodate the blind and physically challenged person's individual needs. Also shown is a forwardly located spillway having a lip and a solid waste blocking member for channeling the overflow water of the toilet to one area for ease of cleanup.

Turning to FIG. 3, shown therein is a perspective view of the present invention 10 showing the toilet having air indraft members 32, which are removably attached for cleaning purposes, positioned over the toilet venting receptacles. The toilet venting receptacle egress port communicates with and is connected by conduit 36 to an egress port for venting the malodorous odors outside of the lavatory. Also shown are integrally molded toilet paper holders 24 providing a consistently memorable location for the blind and physically challenged. The toilet paper holders 24 can be moved on horizontal notched sliding means 38 either to the front or rear of the toilet bowl 22 to accommodate the blind and physically challenged person's individual needs. Also shown is a forwardly located spillway 12 having a lip and a solid waste blocking member 14 for channeling the overflow water of the toilet to one area for ease of cleanup.

Figure 4:
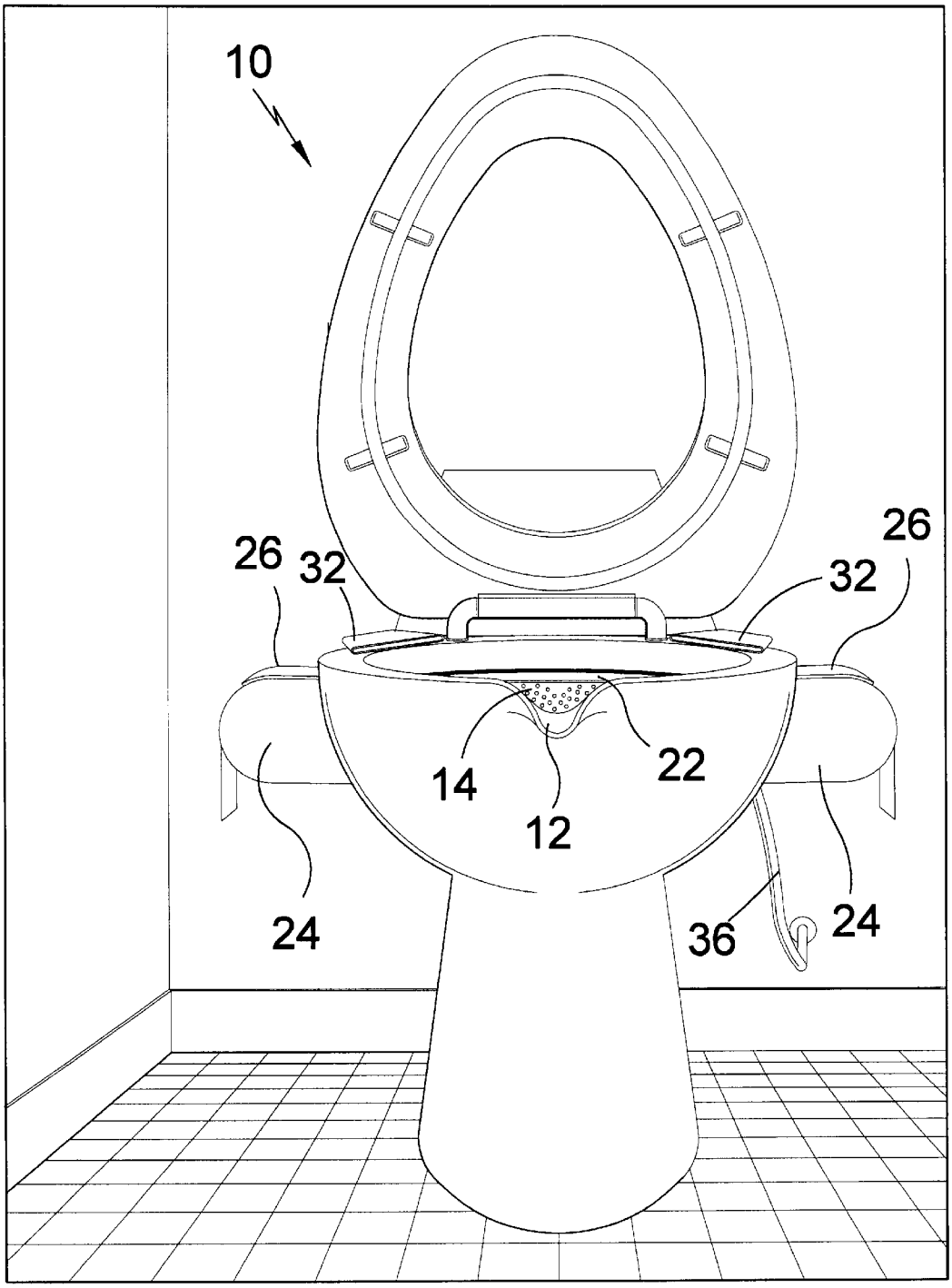
FIG. 4 is a front view of the present invention showing the spillway having a solid waste blocking member which will act to retain solid waste while channeling the overflow, due to waste line blockage, forwardly and away from the toilet bowl exterior surface which will result in less contamination of the exterior toilet bowl surface and reduce splashing of lavatory walls.

Turning to FIG. 4, shown therein is a front view of the present invention 10 showing the spillway 12 having a solid waste blocking member 14 which will act to retain solid waste while channeling the overflow, due to waste line blockage, forwardly and away from the toilet bowl exterior surface which will result in less contamination of the exterior toilet bowl surface and reduce splashing on lavatory walls.

Also shown are the integrally molded toilet paper holders 14 providing a memorably consistent location for the visually and physically challenged with integrally molded covers which can be hinged.

The air indraft members 32 seated within the toilet venting receptacles provide air removal means for removal of malodorous odors from the toilet bowl area through conduit 36 to an external filtration and/or venting assembly having an exhaust fan to draw the malodorous air from the toilet bowl through the venting and/or filtration system.

Figure 5:
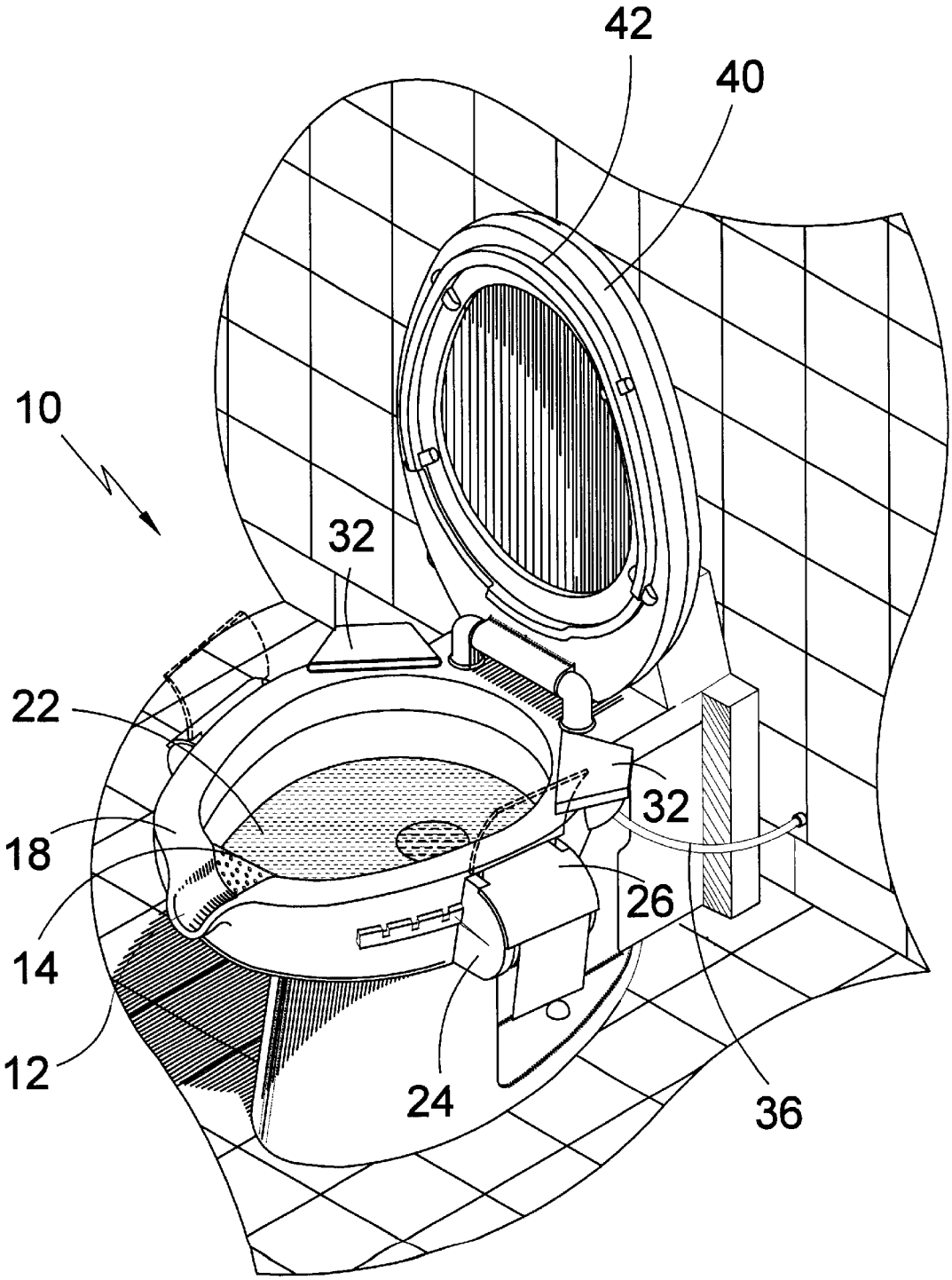
FIG. 5 is a perspective view of the present invention showing the spillway having a solid waste blocking member which will act to channel the overflow, due to waste line blockage, forwardly which will result in less contamination of the exterior toilet bowl surface and reduce splashing of lavatory walls.

Turning to FIG. 5, shown therein is a perspective view of the present invention 10 showing the spillway 12 having a solid waste blocking member 14 which will act to channel the overflow, due to waste line blockage, forwardly which will result in less contamination of the exterior toilet bowl surface and reduce splashing on lavatory walls.

The integrally molded toilet paper holders 24 provide a memorably consistent location for the visually and physically challenge and have either an integrally molded cover 26 or a hinged cover.

The air indraft members 32 seated within the toilet venting receptacles and connected by means of conduit 36 to an air egress port connected to a forced air exhaust member, not shown, which will draw the air from the toilet bowl 22 area having the malodorous odors and venting the air outside of the lavatory. Also shown is a hinged toilet seat 40 with a completely encircling seal 42 on its underside which will seal 42 to the rim 18 of the toilet bowl 22 thereby limiting the air intake to the front of the bowl before passing through the air venting apparatus.

Figure 6:
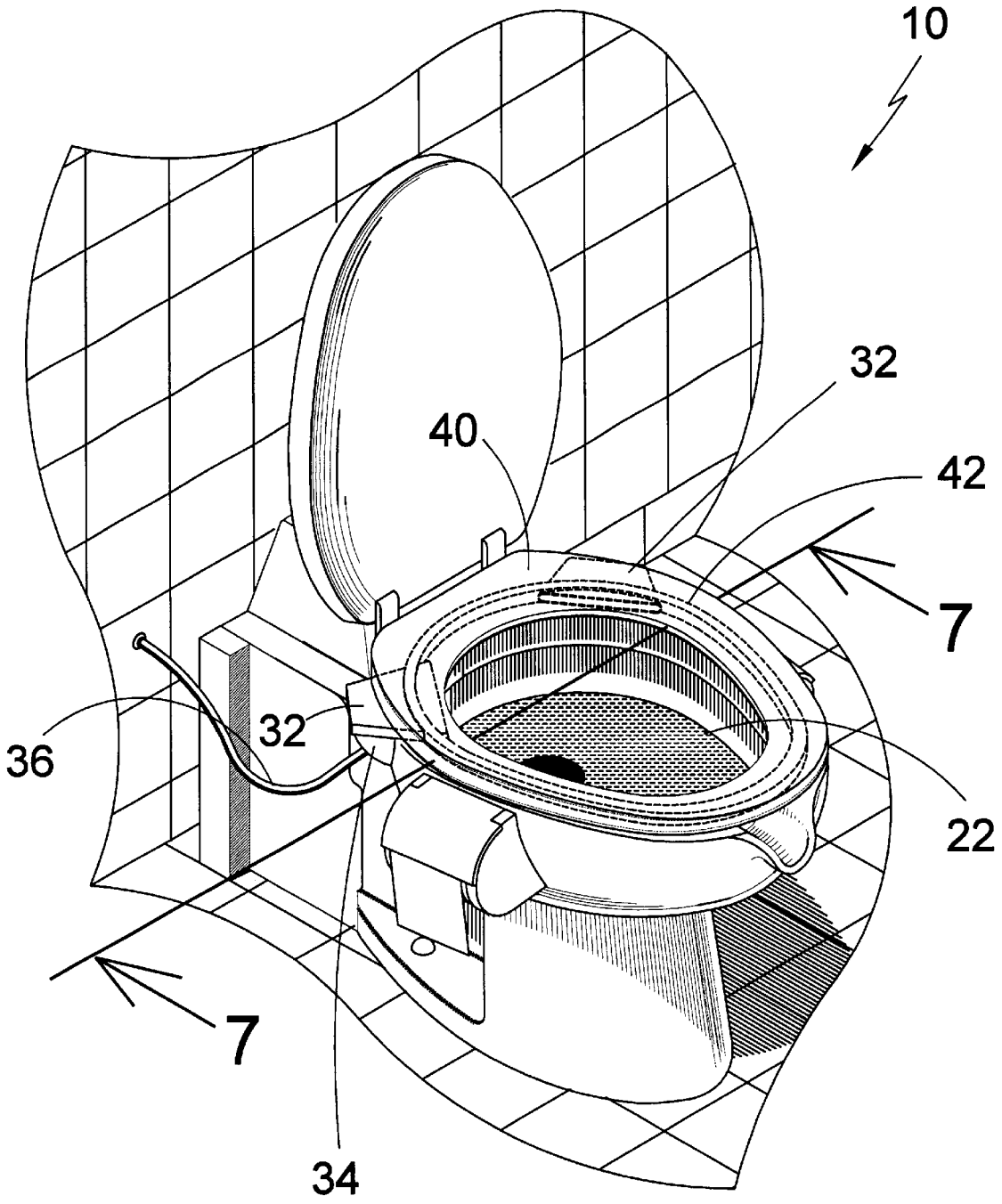
FIG. 6 is a perspective view of the present invention with the toilet seat in the down position having rim-sealing means shown in outline. Shown is the venting toilet receptacle attach by means of conduit to an external venting system, not shown, the malodorous air from the toilet bowl will be drawn by means of an air indraft member through a hollow tubular or flexible rubber instrument that would be attached to an electric blower which shall draft the malodorous air from the interior of the toilet bowl. The electric blower would then exhaust the malodorous odors into a crawl space under the house, crawl space above the ceiling, vacant cavity of some sort, vented to the exterior or the building, or an instrument to filter the odors out of the malodorous air whereas the air could then be recirculated.

Turning to FIG. 6, shown therein is a perspective view of the present invention 10 with the toilet seat 40 in the down position having rim sealing means 42 shown in outline. Shown are the pair of venting toilet receptacles 34 attached by means of conduit 36 to an external venting system, not shown. The malodorous air from the toilet bowl 22 will be drawn by means of an air indraft member 32 through a hollow tubular or flexible rubber instrument that would be attached to an electric blower which will draft the malodorous air from the interior of the toilet bowl 22. The electric blower would then exhaust the malodorous odors into a crawl space under the house, crawl space above the ceiling, vacant cavity of some sort, vented to the exterior or the building, or an instrument to filter the odors out of the malodorous air whereas the air could then be recirculated.

The electric blower could be activated by an electric switch on the wall next to the toilet, by being wired to a restroom light switch, by an electric timer switch, by a photo sensor, or by an electric eye. The idea of the blower being activated by a photo sensor or by an electric eye would be of assistance for the blind or disabled.

Figure 7:
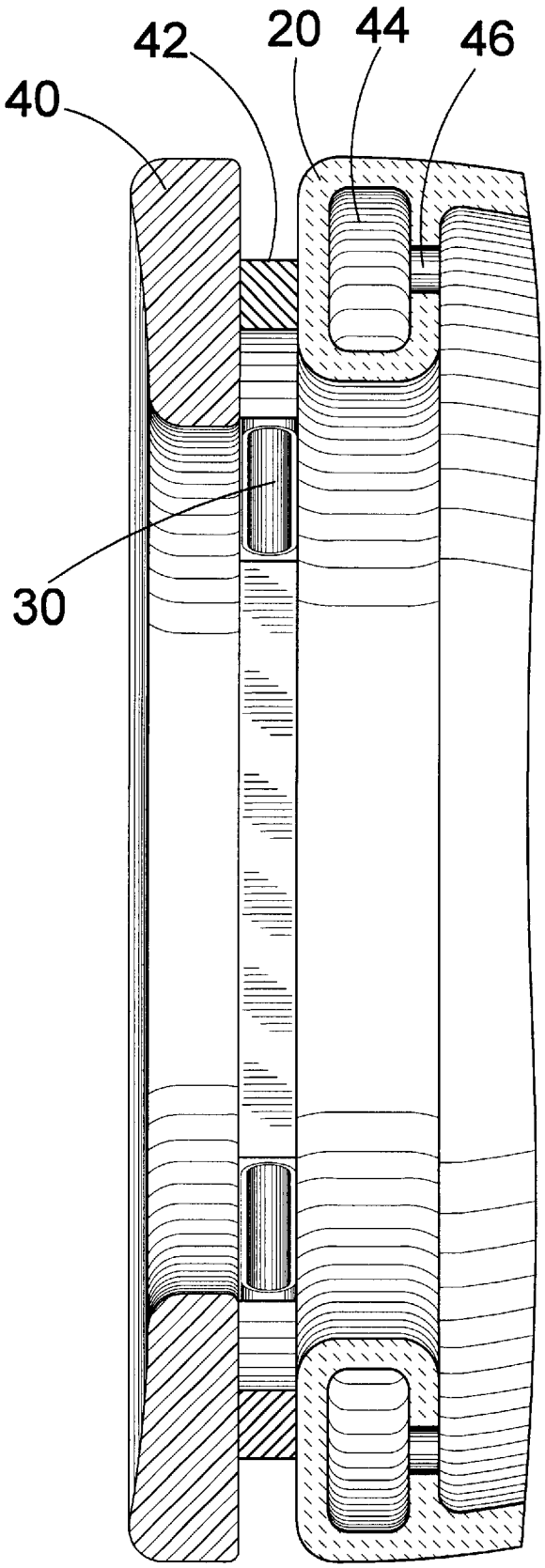
FIG. 7 is a cross sectional view of the toilet, taken from FIG. 5 as indicated, showing the toilet bowl rim having a water passage unit within the rim and the toilet seat having sealing means substantially closing the source of air being supplied to the air indraft members to the front of the toilet.

Turning to FIG. 7, shown therein is a cross sectional view of the toilet, taken from FIG. 6 as indicated, showing the toilet bowl rim 20 having a water passage unit 44 with outlet apertures 46 within the rim 20 and the toilet seat 40 having sealing means 42 substantially closing the source of air being supplied to the air indraft ports 30 from the front of the toilet.

Figure 8:
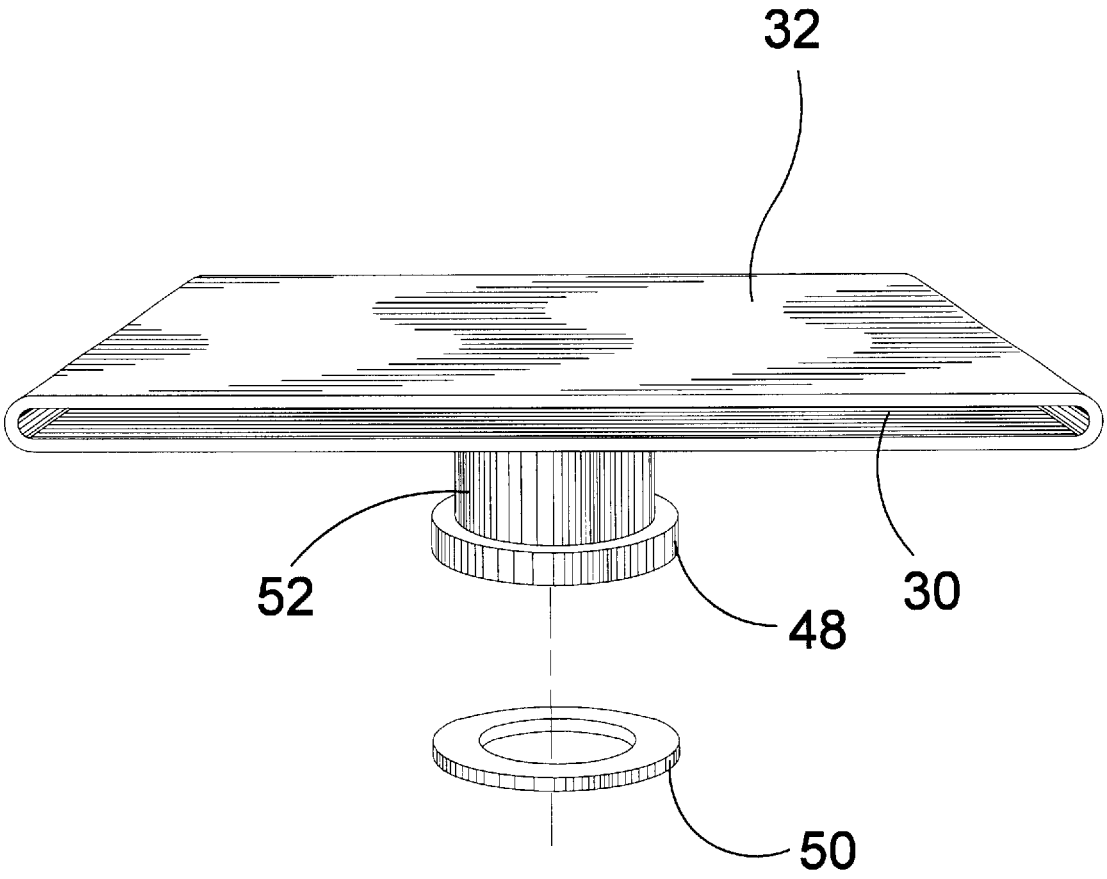
FIG. 8 is a front perspective view of the air indraft member having a slot-shaped aperture which substantially conforms in height to the space between the bottom of the toilet seat and the rim of the toilet. Also said indraft member has a base collar which substantially conform to the inside diameter of the toilet venting receptacle and a gasket for sealing the indraft member to the toilet bowl.

Turning to FIG. 8, shown therein is a front perspective view of the air indraft member 32 having a slot-shaped aperture 30 which substantially conforms in height to the space between the bottom of the toilet seat and the rim of the toilet. Also, the indraft member 32 has a base collar 48 on the end of a downwardly extending conduit 52 which collar 48 substantially conforms to the inside diameter of the toilet venting receptacle and a gasket 50 for sealing the indraft member 32 to the toilet bowl.

Figure 9:
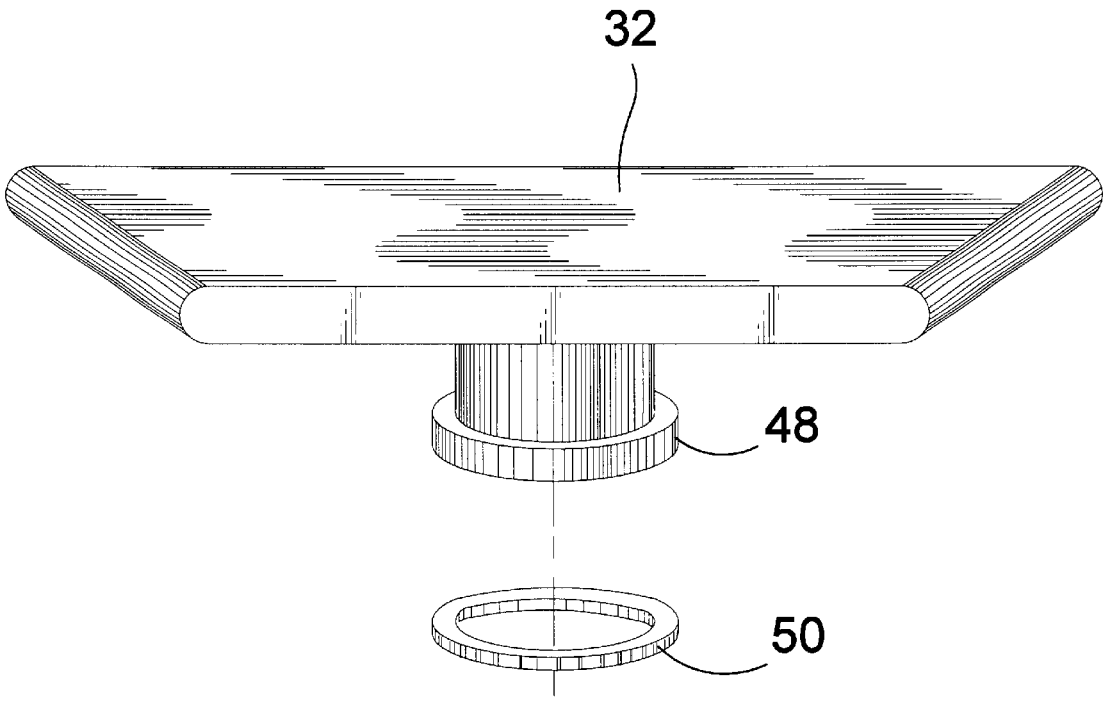
FIG. 9 is a rear perspective view of the air indraft member showing a head area which substantially conforms in height to the space between the bottom of the toilet seat and the rim of the toilet. Also said indraft member having a base collar which substantially conform to the inside diameter of the toilet-venting receptacle.

Turning to FIG. 9, shown therein is a rear perspective view of the air indraft member 32 showing a head thickness which substantially conforms in height to the space between the bottom of the toilet seat and the rim of the toilet. Also the indraft member 32 having a base collar 48 with gasket 50 which substantially conform to the inside diameter of the toilet venting receptacle.

Figure 10:
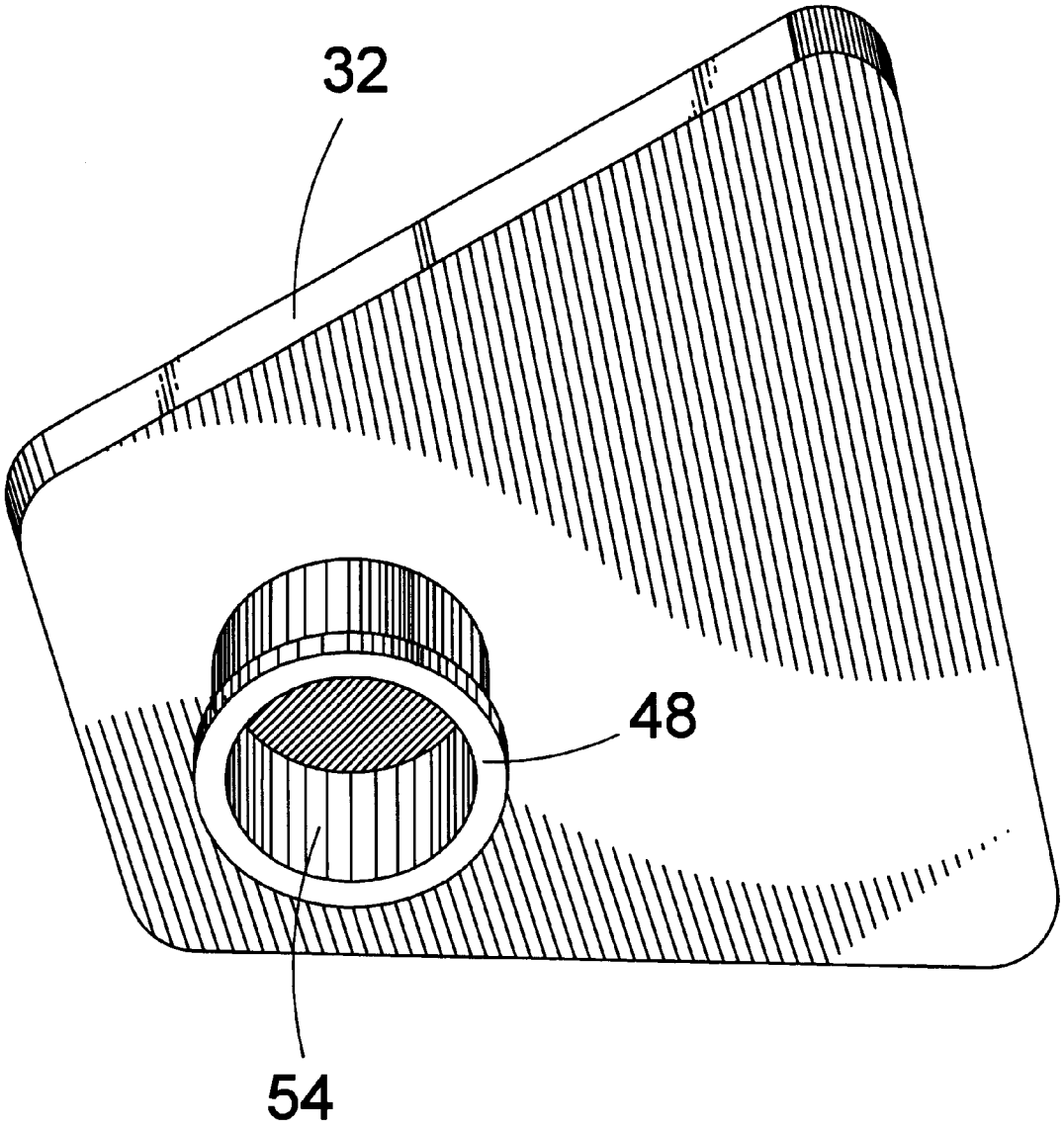
FIG. 10 is a bottom perspective view of the air indraft member showing the air egress port and the base collar which substantially conform to the inside diameter of the toilet-venting receptacle.

Turning to FIG. 10, shown therein is a bottom perspective view of the air indraft member 32 showing the air egress port 54 and the base collar 48 which substantially conforms to the inside diameter of the toilet venting receptacle.

Figure 11:
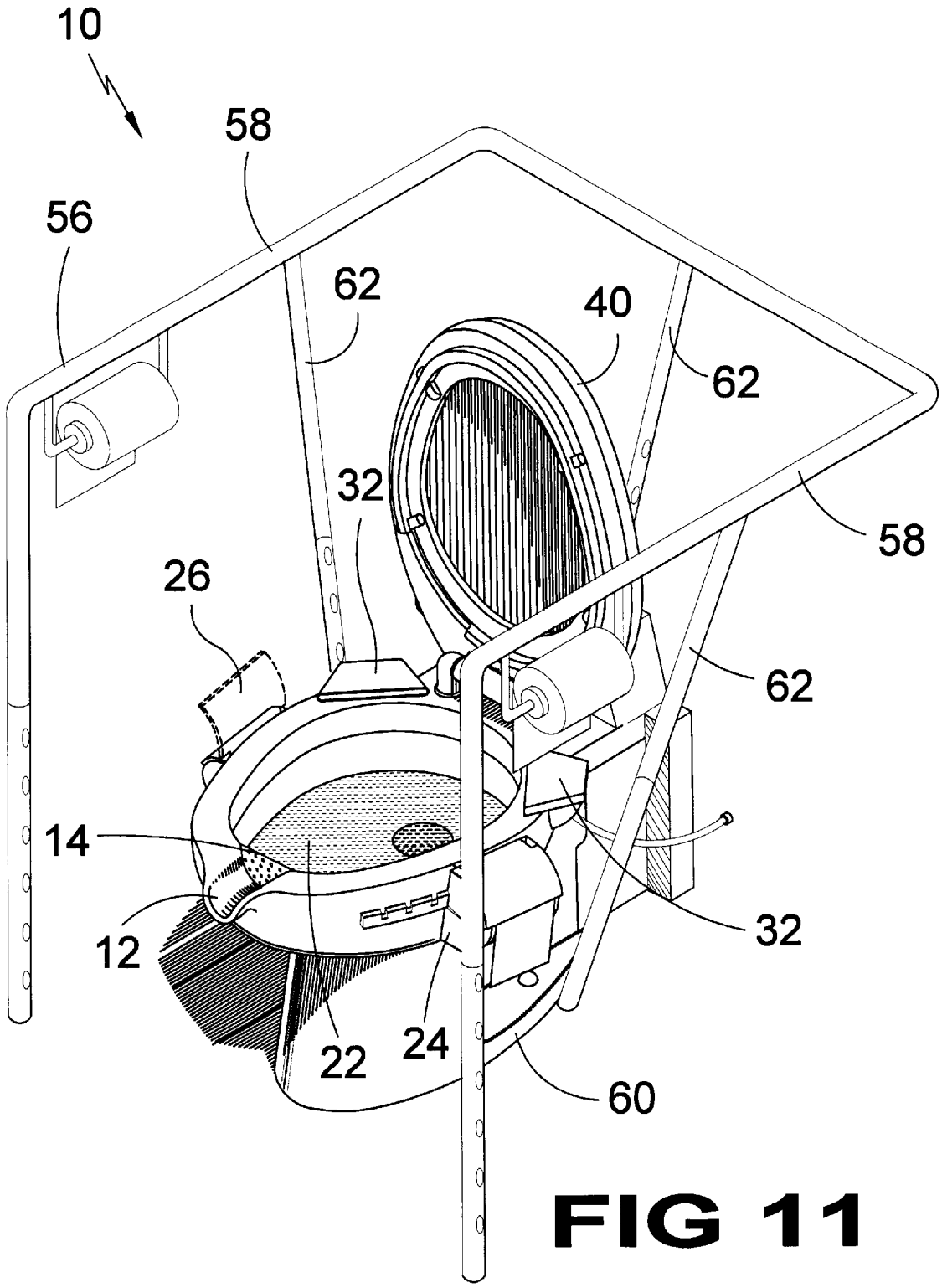
FIG. 11 is a perspective view of the present invention showing an additional element in the form a height adjustable stand which can be positioned by the user to aid in mounting and dismounting from the toilet seat. The height adjustable bars are attached or can be attached to the rear of the toilet bowl base and the wall.

Turning to FIG. 11, shown therein is a perspective view of the present invention 10 showing an additional element in the form a height adjustable stand 56 which can be positioned by the user to aid in mounting and dismounting from the toilet seat. The height adjustable bars 58 are attached with support members 62 or can be attached to the rear of the toilet bowl base 60 and the wall. Also shown are elements previously disclosed.

Figure 12:
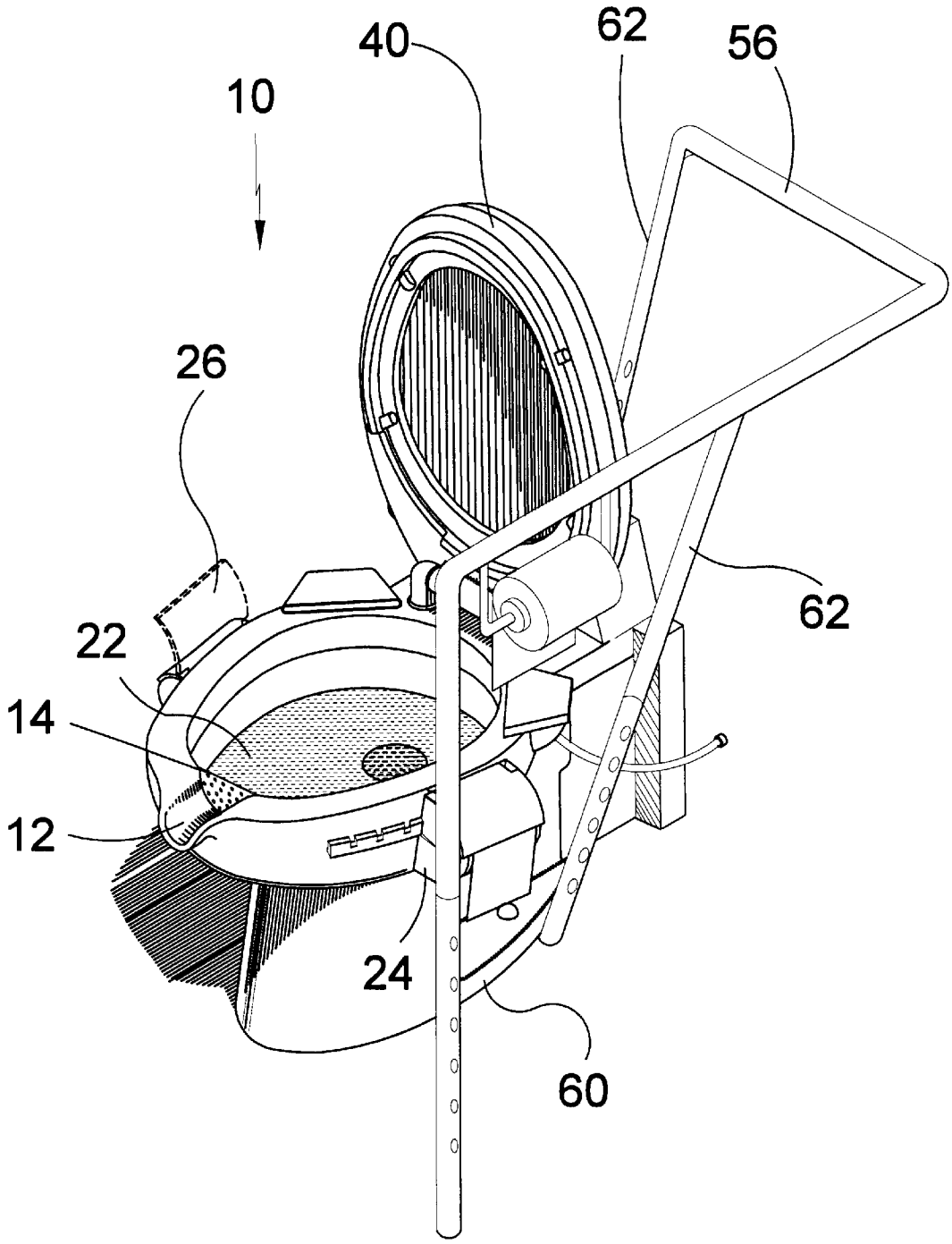
FIG. 12 is a perspective view of the present invention showing an additional element in the form a height adjustable stand mounted to the right side of the toilet which can be positioned by the user on the right or left side to aid in mounting and dismounting from the toilet seat. The height adjustable bars are attached or can be attached to the rear of the toilet bowl base and the wall.

Turning to FIG. 12, shown therein is a perspective view of the present invention 10 showing an additional element in the form a height adjustable hand stand 56 mounted to the right side of the toilet 22 which can be positioned by the user on the right or left side to aid in mounting and dismounting from the toilet seat 40. The height adjustable bars 58 are attached or can be attached to the rear of the toilet bowl base 60 and the wall using support member 62. Also shown are elements previously disclosed.

Figure 13:
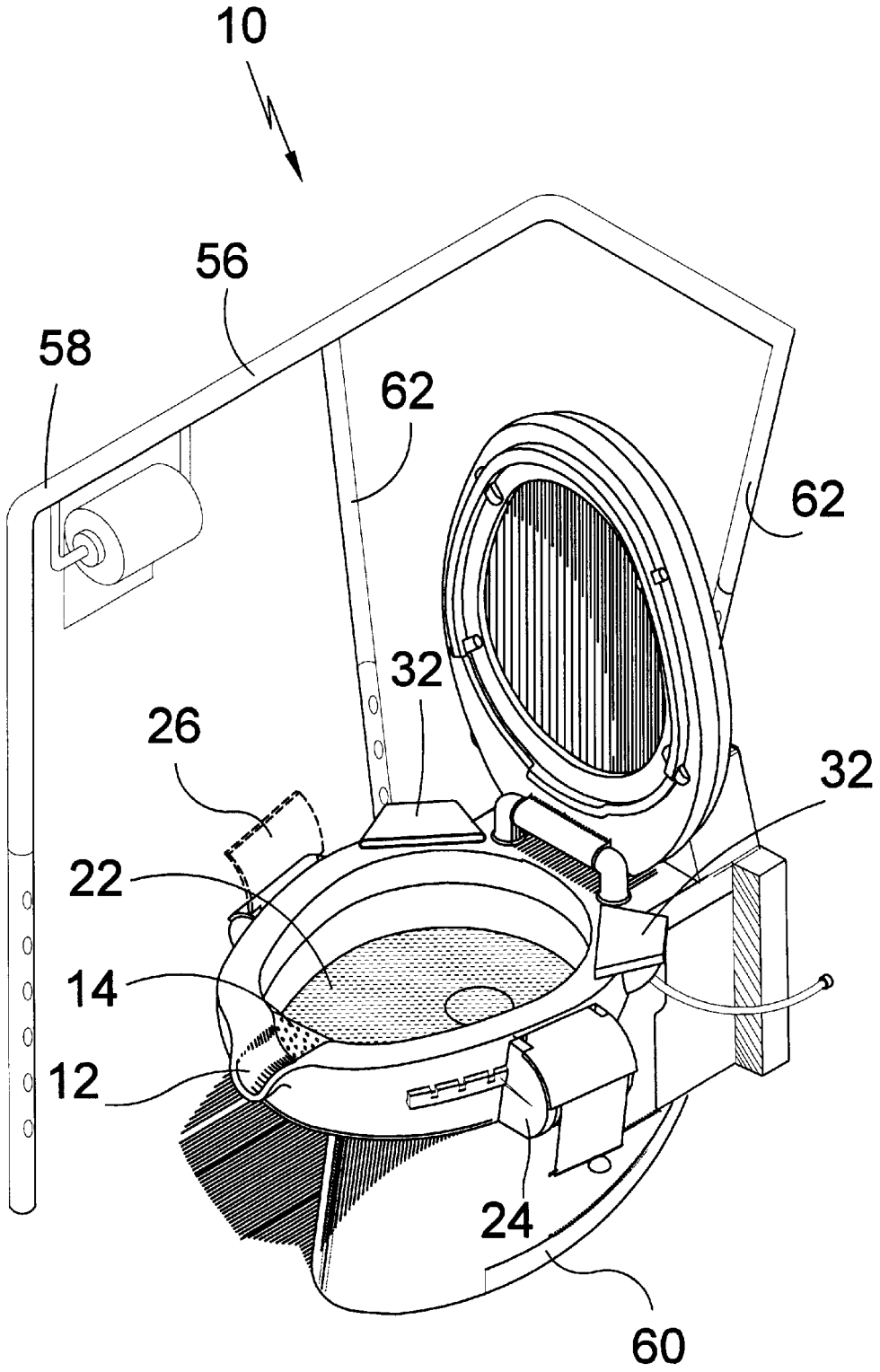
FIG. 13 is a perspective view of the present invention showing an additional element in the form a height adjustable stand mounted to the left side of the toilet which can be positioned by the user on the right or left side to aid in mounting and dismounting from the toilet seat. The height adjustable bars are attached or can be attached to the rear of the toilet bowl base and the wall.

Turning to FIG. 13, shown therein is a perspective view of the present invention 10 showing an additional element in the form a height adjustable stand 56 mounted to the left side of the toilet 22 which can be positioned by the user on the right or left side to aid in mounting and dismounting from the toilet seat. The height adjustable bars 58 are attached or can be attached by means 62 to the rear of the toilet bowl base 60 and the wall. Also shown arc elements previously disclosed.

Figure 14:
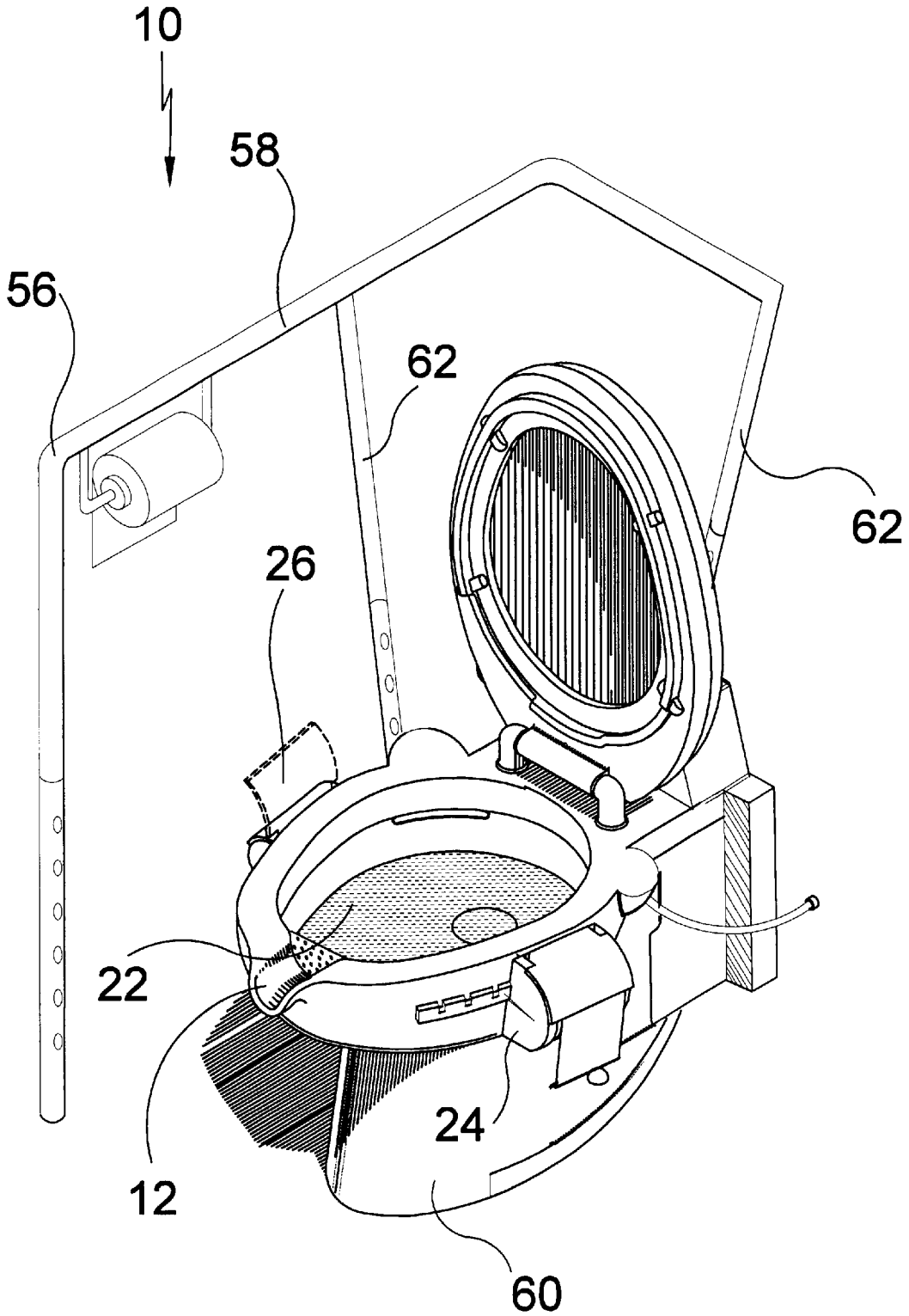
FIG. 14 is a perspective view of the present invention showing an additional element in the form a height adjustable stand positioned on the right side which can be positioned by the user on the right or left side to aid in mounting and dismounting from the toilet seat. The height adjustable bars are attached or can be attached to the rear of the toilet bowl base and the wall.

Turning to FIG. 14, shown therein is a perspective view of the present invention 10 showing an additional element in the form a height adjustable stand 56 positioned on the left side which can be positioned by the user on the right or left side to aid in mounting and dismounting from the toilet seat. The height adjustable bars 58 are attached or can be attached by means 62 to the rear of the toilet bowl base 60 and the wall. Also shown are elements previously disclosed.

Figure 15:
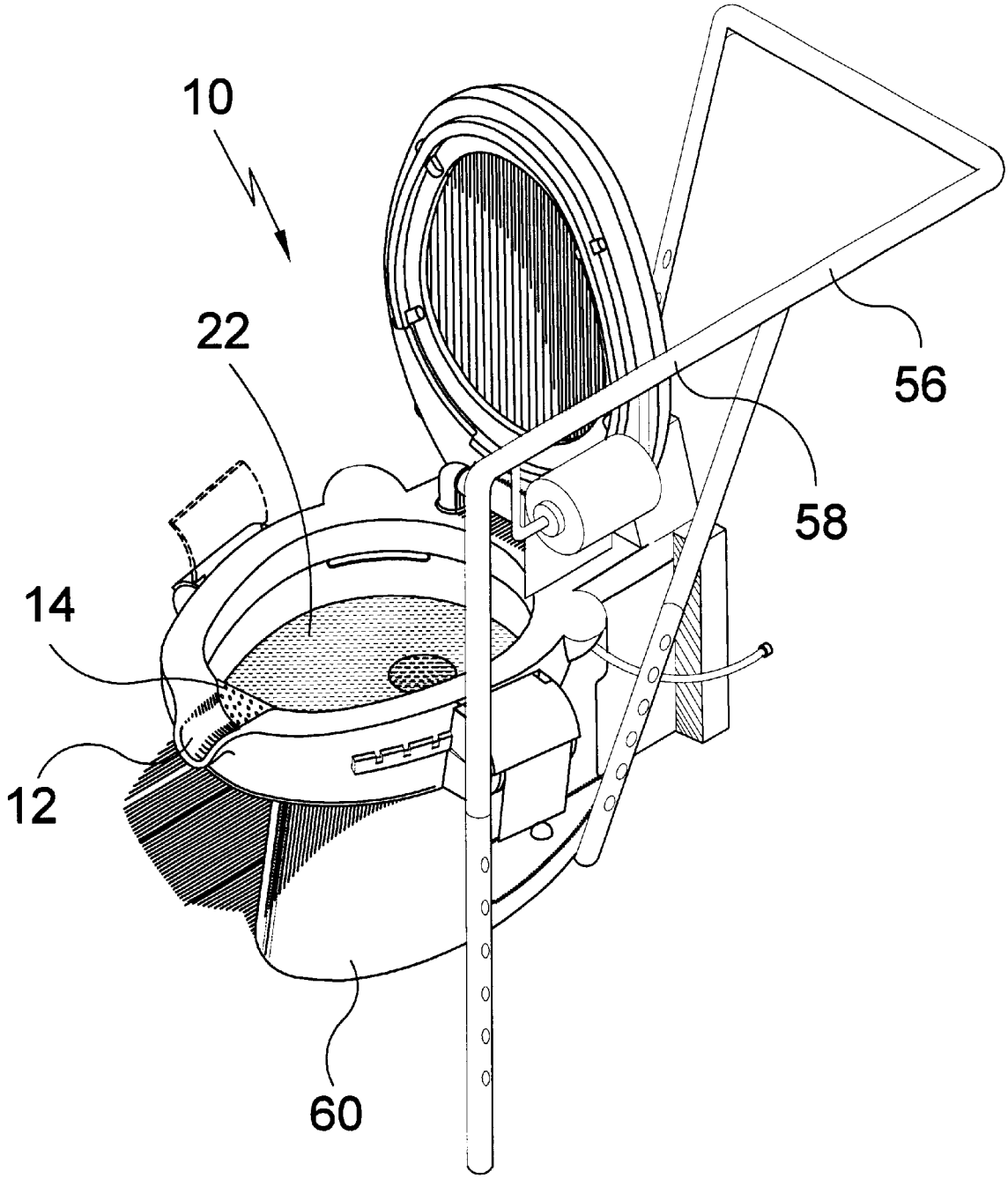
FIG. 15 is a perspective view of the present invention showing an additional element in the form a height adjustable stand positioned on the left side which can be positioned by the user on the right or left side to aid in mounting and dismounting from the toilet seat. The height adjustable bars are attached or can be attached to the rear of the toilet bowl base and the wall.

Turning to FIG. 15, shown therein is a perspective view of the present invention 10 showing an additional element in the form a height adjustable stand 56 positioned on the right side which can be positioned by the user on the right or left side to aid in mounting and dismounting from the toilet seat. The height adjustable bars 58 are attached or can be attached to the rear of the toilet bowl base 60 and the wall. Also shown are elements previously disclosed.

Figure 16:
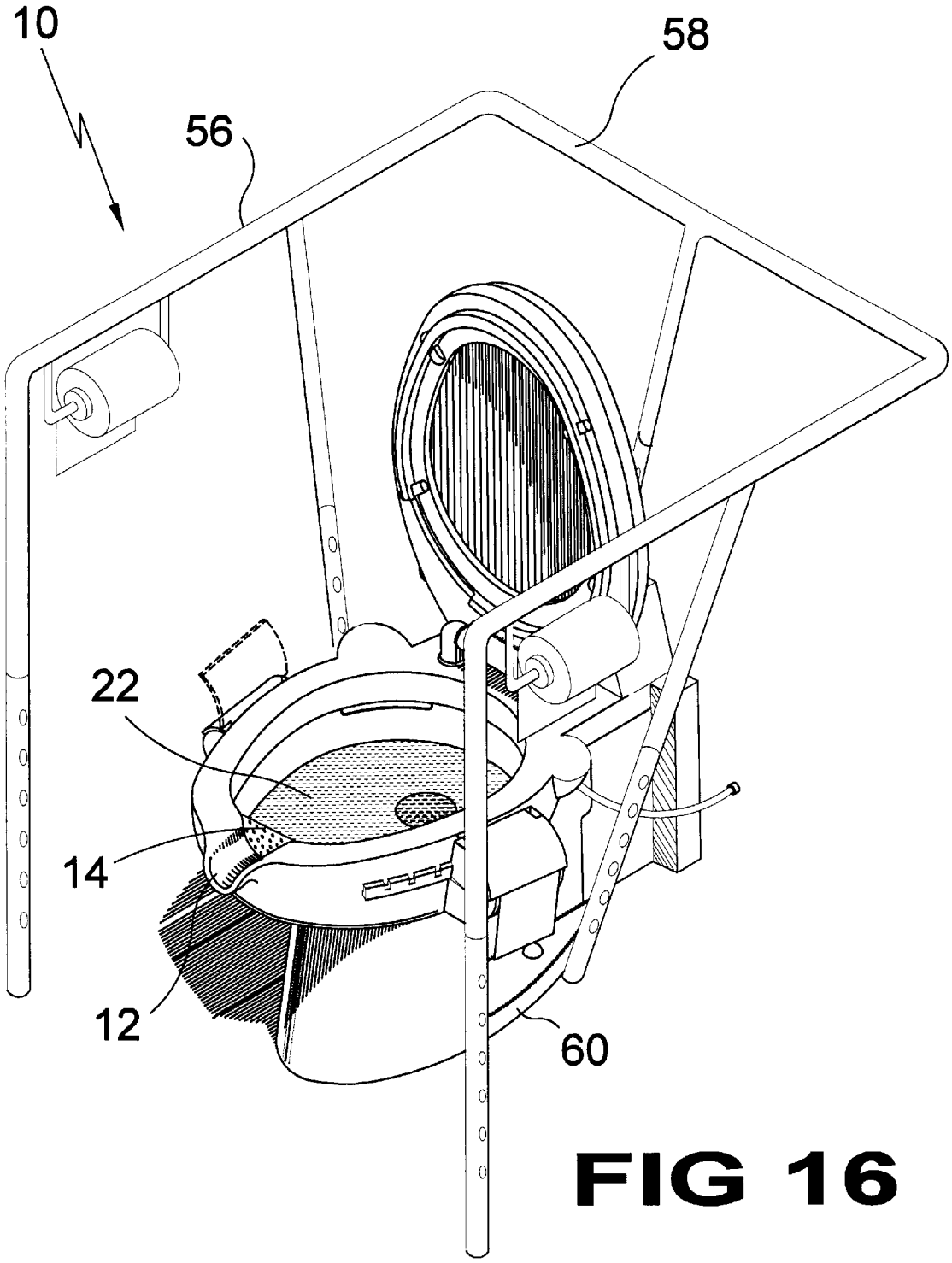
FIG. 16 is a perspective view of the present invention showing an additional element in the form a height adjustable stand positioned around the toilet to aid in mounting and dismounting from the toilet seat. The height adjustable bars are attached or can be attached to the rear of the toilet bowl base and the wall.

Turning to FIG. 16, shown therein is a perspective view of the present invention 10 showing an additional element in the form a height adjustable stand 56 positioned around the toilet to aid in mounting and dismounting from the toilet seat. The height adjustable bars 58 are attached or can be attached to the rear of the toilet bowl base 60 and the wall. Also shown are elements previously disclosed.

Figure 17:
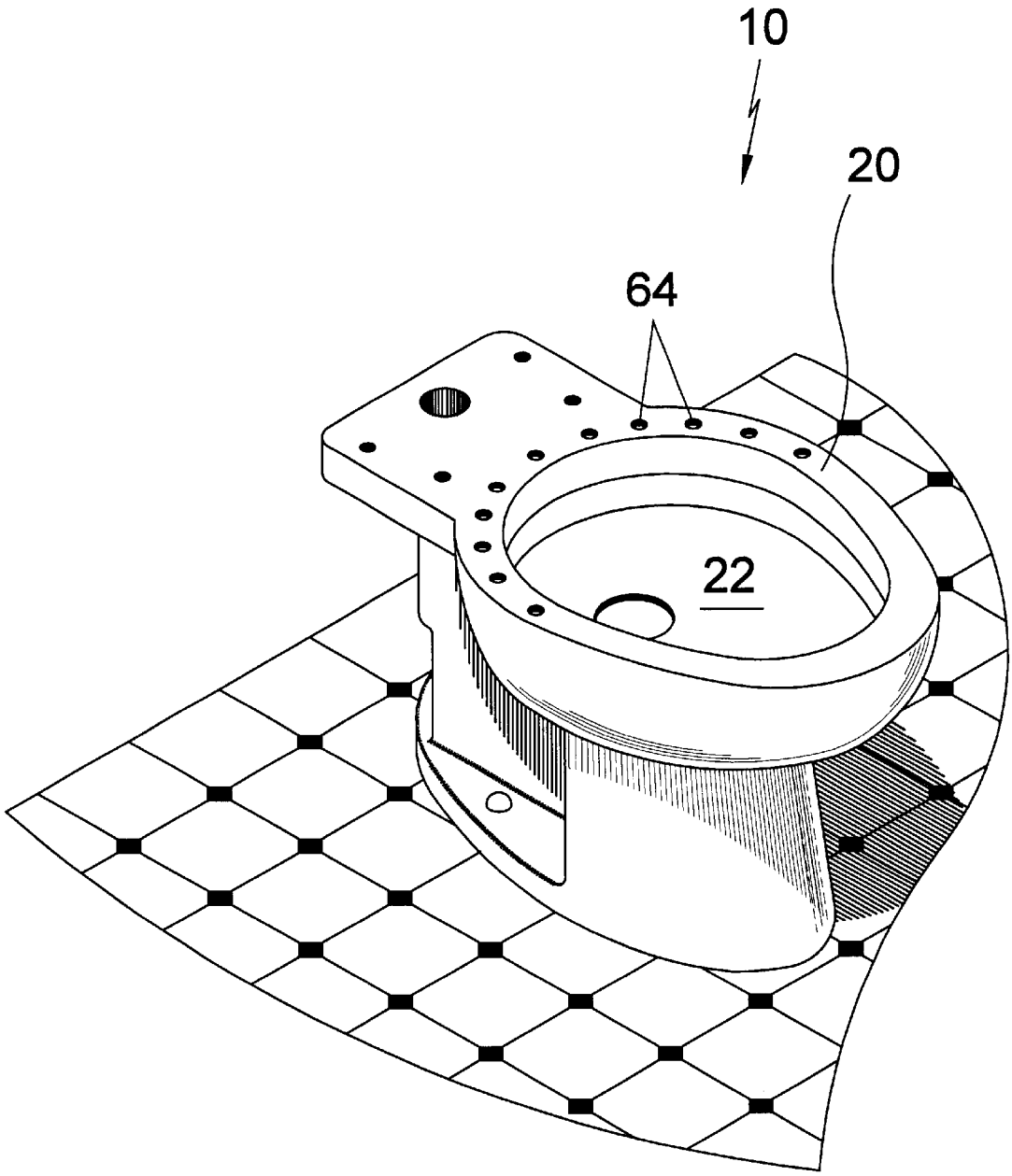
FIG. 17 is a perspective view of the present invention wherein the air indraft is incorporated into the rim area of the toilet having indraft means through a number of apertures located within the upper surface of the rim of the toilet.

Turning to FIG. 17, shown therein is a perspective view of the present invention 10 wherein the air indraft is incorporated into the rim 20 area of the toilet 22 having indraft means through a number of apertures 64 located within the upper surface of the rim 20 of the toilet 22. Apertures 64 communicate through an air channel interior the rim 20 with the conduit for removing odors from the room.

Figure 18:
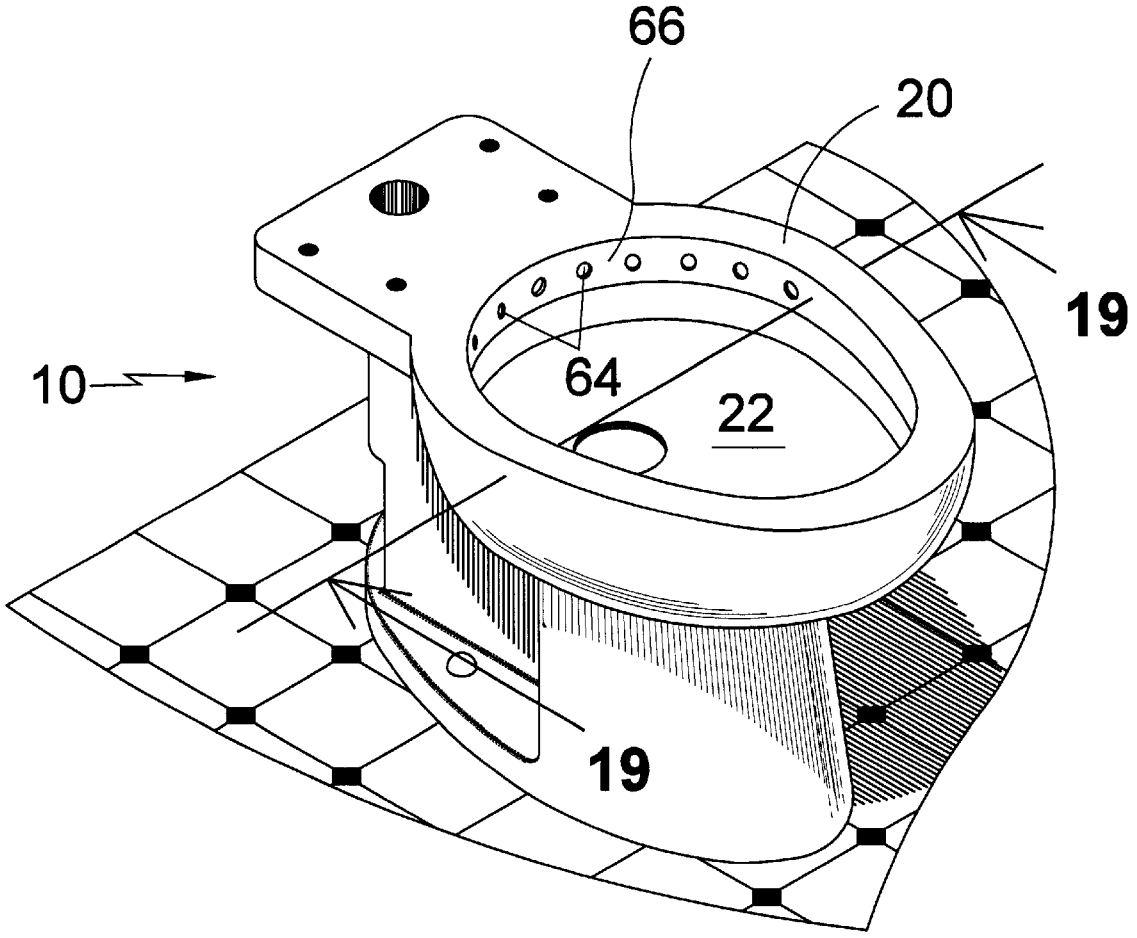
FIG. 18 is a perspective view of the present invention wherein the air indraft is incorporated into the rim area of the toilet bowl having indraft means through a number of apertures located within the interior vertical rim wall of the toilet.

Turning to FIG. 18, shown therein is a perspective view of the present invention 10 wherein the air indraft is incorporated into the rim 20 area of the toilet bowl 22 having indraft means through a number of apertures 64 located within the interior vertical rim wall 66 of the toilet 22. Apertures 64 communicate through an air channel interior the rim 20 with the conduit for removing odors from the room.

Figure 19:
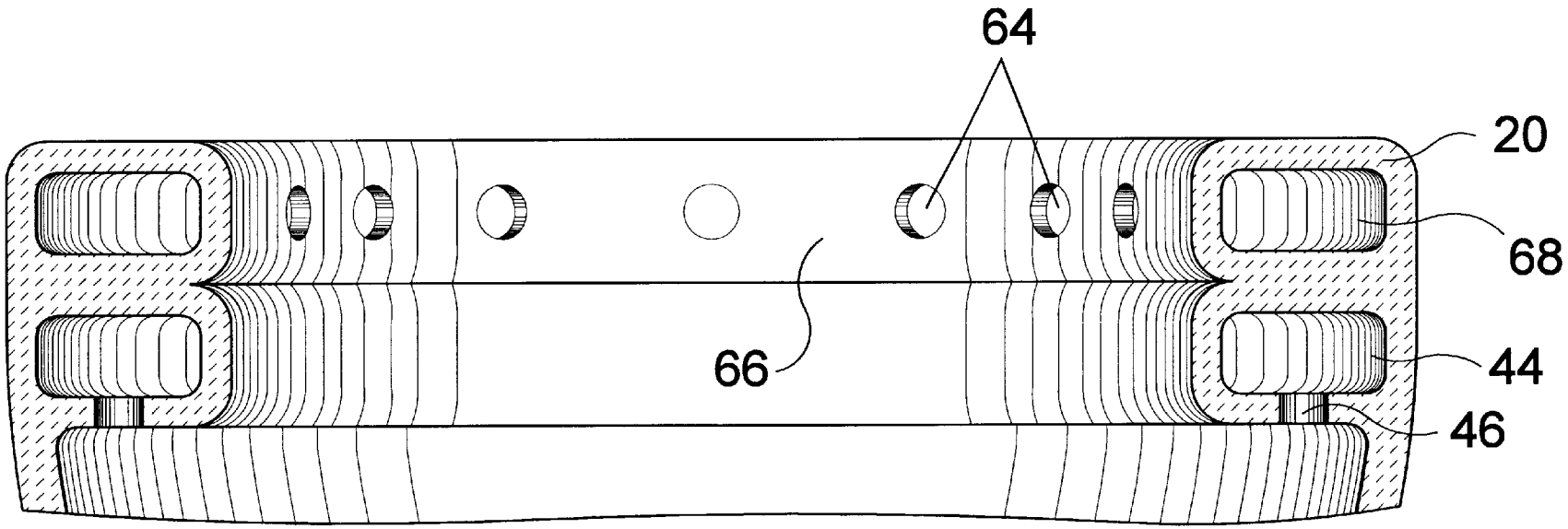
FIG. 19 is a cross sectional view, taken from FIG. 13 as indicated, showing the double channel from the rim of the toilet wherein the upper channel having a number of apertures within the interior vertical rim wall forms the function of the air indraft member and the lower channel continues to act as the passageway for the water in the flush cycle having apertures leading into the toilet bowl.

Turning to FIG. 19, shown therein is a cross sectional view, taken from FIG. 18 as indicated, showing the double channel forming the rim 20 of the toilet wherein the upper air channel 68 having a number of apertures 64 within the interior vertical rim wall 66 forms the function of the air indraft member which communicates with the conduit and the lower channel 44 continues to act as the passageway for the water in the flush cycle having apertures 46 leading into the toilet bowl 22.

LIST OF REFERENCE NUMERALS

With regard to reference numerals used, the following numbering is used throughout the drawings.

10 present invention
12 spillway
14 solid waste blocking member
16 front
18 side
20 rim
22 toilet bowl
24 toilet paper holders
26 toiler paper cover
28 seat
30 air indraft ports
32 air indraft members
34 toilet venting receptacle
36 conduit
38 sliding means
40 toilet seat
42 rim sealing means
44 water passage
46 water passage outlet aperture
48 base collar
50 gasket
52 downward conduit
54 air egress port
56 hand stand
58 hand bars
60 toilet base
62 support member
64 indraft apertures
66 vertical wall
68 air channel

I claim:

1. A toilet apparatus including a bowl having a rim thereon, comprising:

a) a spillway disposed in the rim of the toilet bowl for directing an overflow in said toilet bowl in a single direction out of said toilet bowl, said spillway disposed on the front of the toilet bowl;

b) a solid waste screening member disposed across said spillway;

c) at least one toilet paper holder disposed on the side of the toilet bowl;

d) an air removal means whereby malodorous vapors from the toilet bowl are removed therefrom;

e) a conduit for conveying the malodorous vapors captured by said air removals means away from the toilet bowl; and, f) an exhaust means for removing and exhausting air from said conduit.

2. The apparatus of claim 1, wherein said spillway has the shape of a semi-circle, said semi-circle having a diameter approximately equal to the width of the rim of the toilet bowl.

3. The apparatus of claim 1, said solid waste screening member further comprising a thin plate having multiple apertures therein disposed perpendicular to said spillway.

4. The apparatus of claim 1, further comprising a pair of said toilet paper holders.

5. The apparatus of claim 1, said at least one toilet paper holder having means for being slidably mounted onto the toilet bowl whereby each said holder can slide along a respective side of the toilet bowl.

6. The apparatus of claim 5, said means for being slidably mounted further comprises a generally horizontal track member upon which each said toilet paper holder slides.

7. The apparatus of claim 6, said track member having a plurality of spaced apart notches therein, said notches for securing said toilet paper holder there to.

8. The apparatus of claim 1, said air removal means further comprising a pair of air inlet ports, said air inlet ports disposed under the rim of the toilet bowl in the wall of the toilet bowl.

9. The apparatus of claim 1, further comprising a hinged toilet seat, said toilet seat having a sealing means disposed on its underside for forming a seal between said toilet seat and the rim of the toilet bowl.

10. The apparatus of claim 9, further comprising an air indraft member disposed between the rim of the toilet bowl and said toilet seat, said air indraft member having a slot-shaped aperture therein, said aperture sized to fit between the rim and said toilet seat, said air indraft member having a downwardly extending base tubular member.

11. The apparatus of claim 10, further comprising a toilet venting receptacle disposed in the top of the rim of the toilet bowl, said toilet venting receptacle for receiving said downwardly extending base tubular member, said toilet venting receptacle communicating with said conduit for conveying vapors away from the toilet bowl.

12. The apparatus of claim 1, said air removal means further comprising a plurality of apertures disposed on the upper surface of the rim of the toilet bowl, the rim further comprising an air channel therein, said air channel communicating with said plurality of apertures, said air channel communicating with said conduit for conveying vapors away from the toilet bowl.

13. The apparatus of claim 1, said air removal means further comprising a plurality of apertures disposed on the interior vertical wall of the rim of the toilet bowl, the rim further comprising an air channel therein, said air channel communicating with said plurality of apertures, said air channel communicating with said conduit for conveying vapors away from the toilet bowl.

14. The apparatus of claim 1, further comprising a handrail disposed about the toilet bowl whereby a user can use said handrail for assistance in sitting down upon and arising from the toilet.

15. The apparatus of claim 14, further comprising height adjustment means disposed on said handrail whereby the height of said handrail can be varied.

16. The apparatus of claim 15, further comprising of supporting means for said handrail, said supporting means connecting to the base of the toilet bowl.

17. The apparatus of claim 1, said exhaust means further comprising a fan.

* * * * *